US007553269B2

(12) United States Patent
DeMatteis et al.

(10) Patent No.: US 7,553,269 B2
(45) Date of Patent: Jun. 30, 2009

(54) METHOD OF MANUFACTURING A BAG

(76) Inventors: Robert B. DeMatteis, 15850 McCourtney Rd., Grass Valley, CA (US) 95949; Donald J. Pansier, 3015 Apollo Ave., Green Bay, WI (US) 54313-6929

( * ) Notice: Subject to any disclaimer, the term of this patent is extended or adjusted under 35 U.S.C. 154(b) by 0 days.

(21) Appl. No.: 11/278,888

(22) Filed: Apr. 6, 2006

(65) Prior Publication Data

US 2006/0189468 A1 Aug. 24, 2006

Related U.S. Application Data

(63) Continuation of application No. 10/481,556, filed on Dec. 19, 2003, now abandoned.

(60) Provisional application No. 60/301,612, filed on Jun. 27, 2001, provisional application No. 60/300,591, filed on Jun. 22, 2001.

(51) Int. Cl.
*B31B 1/64* (2006.01)

(52) U.S. Cl. ..... 493/297; 493/269; 493/193; 493/202

(58) Field of Classification Search ..... 493/269, 493/287–290, 189, 193–197, 207, 209
See application file for complete search history.

(56) References Cited

U.S. PATENT DOCUMENTS 2,767,676 A * 10/1956 Johnson et al. ..... 269/48.1
3,130,647 A * 4/1964 Anderson et al. ..... 493/193
3,817,427 A * 6/1974 Neff et al. ..... 222/107
4,690,668 A * 9/1987 Rebmann et al. ..... 493/297
4,950,345 A * 8/1990 Kreager et al. ..... 156/203
5,085,036 A * 2/1992 Evans et al. ..... 53/550
5,356,363 A * 10/1994 Kopp et al. ..... 493/197
6,599,389 B1 * 7/2003 Uneda ..... 156/379.8
6,612,356 B2 * 9/2003 Kong et al. ..... 156/461
6,976,618 B2 * 12/2005 Hallam ..... 229/4.5
2001/0041201 A1 * 11/2001 Ramesh et al. ..... 426/105
2005/0090374 A1 * 4/2005 Helms et al. ..... 493/269

* cited by examiner

*Primary Examiner*—Christopher Harmon

(57) ABSTRACT

A bag having an inwardly disposed seam is manufactured from a sheet of plastic bag material having two major surfaces and two parallel side edges. A first seam seals the two parallel side edges together at the same major surface with the side edges disposed inwardly of the tube to form the sheet of plastic bag material into a tube with internal flap portions extending interiorly of the tube. At least one seal across the tube is provided for forming at least a three-sided bag structure (and preferably two seals across the tube for forming a closed four-sided bag structure) whereby pressure in the interior of the bag acts against the internal flap portions disposed inwardly of the tube to enhance the sealing of the seam. The bag is filled at an opening defined along the opposite side edges of the seam facing inwardly of the tube.

11 Claims, 17 Drawing Sheets

METHOD OF MANUFACTURING A BAG

CROSS REFERENCE TO RELATED APPLICATIONS

I hereby claim benefit under Title 35, United States Code, Section 119(e) of U.S. provisional patent application Ser. No. 60/300,591 filed Jun. 22, 2001 and 60/301,612 filed Jun. 27, 2001, and benefit under Title 35, United States Code, Section 120 of U.S. patent application Ser. No. 10/481,556 filed Dec. 19, 2003 now abandoned. This application is a continuation of the Ser. No. 10/481,556 application. The Ser. No. 10/481,556 application is currently pending. The 60/300,591 application, the 60/301,612 application and the Ser. No. 10/481,556 application are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

This invention relates to plastic bags made from plastic sheeting such as those that may be used for packaging pet foods, foodstuffs and other bulk products. More specifically, this invention relates to the use of these plastic bags in a unique seamless configuration and the process of manufacturing them. This invention also relates to the use of these plastic bags in a unique system which provides for filling and sealing the bags with bulk contents such as pet foods, foodstuffs, concrete, plaster, and the like, in an automated process with a substantially dust-free environment.

2. Description of the Related Art

Any discussion of the prior art throughout the specification should in no way be considered as an admission that such prior art is widely known or forms part of common general knowledge in the field.

Currently, most bags used for bulk contents are standard side-gusseted plastic bags, typically four to five mils thick and are filled from the top bag mouth, then sealed (or sewn closed) and palletized for shipping. Plastic bags of this variety are usually made from sheeting, as opposed to tubing and are highly desirable for bulk use such as packaging fertilizer, lawn maintenance products, seed bags, salt, kitty litter and so on. Generally speaking, these bags are put up in larger sizes to handle loads from as little as 5 pounds to as much as 100 pounds.

The primary reason that sheeting is used to form these bags is that they may be expertly printed in up to 6 colors with process-tone print quality on all panels—front, back and the two sides and, at times, the top and bottom. To make a prior art bag, the printed sheeting is folded over and formed into a layflat tube, the open side edges are matched flush atop one another in the machine direction, lap-sealed (a continuous heat seal), gusseted on the sides, then cut and sealed along a bottom edge to form a bag. This type of high quality printing is restricted on tube-type bags since they are printed independently on the front and the back panels while in a two-sided layflat configuration, before being gusseted. Thus, print registration from front to back is extremely difficult to hold. In the outer portion of the layflat surfaces that become the front and rear gusset panels of the side gussets, it is commonly understood that print copy on the front panel of a gusset should not be attempted to be registered with print copy on the back panel of a side gusset. A further problem with printing tube stock is that the number of colors available to each independent surface is reduced. Since most printing presses have a maximum of 6 print stations (6 colors), there are only 6 color stations total that must be divided between the two surfaces, front and back. Thus, it is impossible to print 6-color process tone print quality on two sides, which would require a total of 12 stations: a set of 6 stations for each independent front and back surface.

When manufacturing a prior art lap seal bag, the two open edges are matched and externally sealed with about a ¼" "lap seal", sealing the two matched edges together, thus forming a tube. When later gusseting the bag, this lap seal seam is usually registered on an outer gusset edge since it naturally points outward anyway. After gusseting, the bag is formed by heat sealing the bottom edge and cutting the top-open bag mouth. This is a fairly common manufacturing process used in industry today. The ¼" lap seal seam that protrudes outward at the gusset edge may distort or interrupt the printing on the bag. Generally speaking, it is undesirable to print where a bag is going to be lap (heat) sealed, as the ink tends to build up on the lap sealer's heat elements when sealing along the printed film edges. But it is also undesirable to leave a lap seal strip unprinted and disrupt the continuity of attractive graphics. Thus, this becomes a predicament to the graphic artist, the bag manufacturer and the retailer.

Most bags used with cement and concrete products and other heavy flowable contents are large multiwall paper bags with fill valves, like those commonly seen palletized in home improvement centers throughout the U.S. They typically contain products, such as 60# mortar and concrete mix and 94# cement and concrete mix, sold to consumers for use in home garden and yard applications. The chief reason paper valve bags are used for these applications is primarily due to per unit cost and productivity factors. Paper valve bags cost more than standard, top-loading plastic bags, but the paper bags are much faster to fill, thus substantially improving productivity and output. There has been some limited use of plastic valve bags made from a woven polypropylene—specially in Europe—that do not lower productivity. But in the U.S. and other countries where paper is still relatively inexpensive, the polypropylene valve bags cost quite a bit more. One of the main reasons they cost more than traditional polyethylene top loading bags is because the equipment used to manufacture them is extremely expensive—as much as ten times that of a standard plastic bag machine.

As anyone experienced in the art knows, there are several problems associated with the prior art. In addition to the high cost, other disadvantages of paper packaging include the consumption of five times the storage space of plastic; the vulnerability of cement and concrete products stored in paper to weather conditions (especially rain), and the vulnerability of paper to pest infestations. In contrast, the superior environmental qualities of plastic are becoming commonly known to retailers and users throughout the country and would be desirable, if practical.

Without question, if a plastic bag could be developed that could eliminate the external lap-sealed seam from sticking out and interrupting print graphics, it would be highly desirable in many applications. Moreover, if a plastic valve bag and system could be developed that could replace the multiwall paper bags cost effectively, without reducing productivity, it would be highly desirable. In fact, if a plastic valve bag were developed that could compete favorably with standard top-fill plastic bags, that too would be highly desirable.

BRIEF SUMMARY OF THE INVENTION

A bag having an inwardly disposed seam is manufactured from a sheet of plastic bag material having two major surfaces and two parallel side edges. A first seam seals the two parallel side edges together at the same major surface with the side edges disposed inwardly of the tube to form the sheet of plastic bag material into a tube with internal flap portions extending interiorly of the tube. At least one seal across the tube is provided for forming at least a three-sided bag structure (and preferably two seals across the tube for forming a closed four-sided bag structure) whereby pressure in the interior of the bag acts against the internal flap portions disposed inwardly of the tube to enhance the sealing of the seam. The bag is filled at an opening defined along the opposite side edges of the seam facing inwardly of the tube. Preferably, at least one additional second seam is placed at the opening and configured at substantial right angles to the first seam. This second seam extends at least from the first seam, joining the side edges inwardly of the bag to form an internal flap portion for closing the opening responsive to pressure in the interior of the bag. The at least one additional second seam is angularly disposed with respect to the first seam to form an opening of variable cross-section, preferably tapering from a wide cross-section at the seam to the narrow cross-section interior of the bag. A tapered conduit having a smaller forward-most end and a larger rearward end is disposed within the opening of the decreasing cross-section from the first seam along the side edges into the interior of the tube. The bag opening is placed over the smaller forward-most end and held tight to the larger rearward end to fit snugly along a portion of the tapered conduit. The bag is filled through the tapered conduit. Air and dust from the filling process are vented. By providing pressure in the interior of the bag and withdrawing the conduit, the filled bag is sealed The variable cross-section opening is pulled from the bag interior to form a pouring spout for metered discharge of the bag contents.

The problems associated with the prior art are overcome by the present invention. That is, the present invention eliminates the protruding lap seal seam and eliminates the requirement to seal atop the ink on printed surfaces. In appearance, it literally creates an attractive, seamless bag, that is friendlier and more forgiving to graphic artists, bag manufacturers and retailers.

The present invention also discloses a new kind of valve bag that is suitable for cement and concrete by-products packaging, costs less than paper and will not sacrifice productivity. Furthermore, the valve bag may be manufactured in a method that allows the valve to be pulled out into a pour spout, which is ideal for many types of products such as seeds, fertilizer and some bulk food products.

In addition, the present invention discloses a method of making the seamless bag and the valve bag that can actually decrease bag machinery costs, making the new method less costly than its traditional counterpart.

The present invention accomplishes these objectives by turning the lap seal inside and thus sealing it along an internal edge with the use of a cantilevered lap sealing system. The cantilevered system is accompanied by an internal former that subsequently gussets the bag in a single internal operation. This method of making an internal lap seal also eliminates the need and cost of external post-gusseters.

The most significant benefits of the unique manufacturing process, system and bag are elimination of the external lap seal, improved graphics, reduced equipment costs, fill valves suitable for filling with flowable contents, and dual-purpose valves that serve as a filling means and also as spouts. And most important, all of this can be accomplished without having a negative impact on the integrity of the product.

The problems associated with the fill valve bags of the prior art are overcome by the present invention. The key to the solution is a high-productivity method that allows for immediate conversion of paper valve-bag filling systems to accommodate inexpensive plastic valve bag alternatives. The bag and system of the present invention accomplish that by using a method of affixing a plastic valve bag onto a unique fill nozzle in a high-productivity manner. As a result, the bag of the invention can outperform both paper filling processes and top-fill plastic bag filling processes.

The present invention also discloses a means of creating a dust-free filling environment. The system is adaptable to several valve bag styles and may be automated as well.

The present invention accomplishes these objectives by using a conical fill nozzle to which a valve bag firmly affixes itself. The fill nozzle also uses a narrowed tip to allow for easier insertion of the bag valve. The filling process may incorporate an air relief system that, in combination with the other attributes, creates not only a dust-free filling environment, but concentrates air and dust removal from the bag being filled to a single location behind the fill nozzle.

The most significant benefits of the unique filling method are the ability to load as quickly as paper, dust containment, and automation potential. All of which is accomplished without having a negative impact on the integrity of the product, and may be used with polyethylene bags that cost less than present day paper or woven polypropylene bags.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
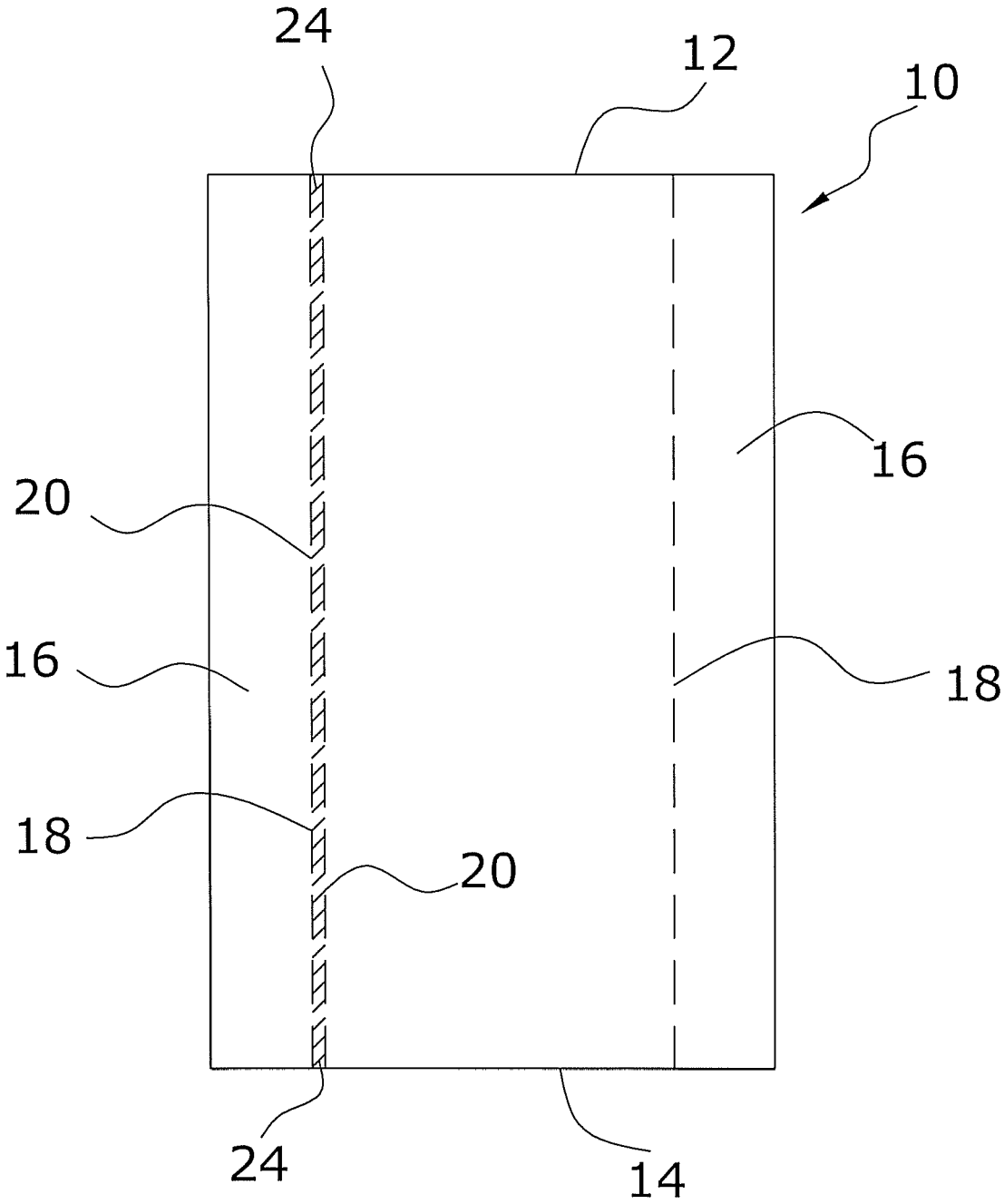
FIG. 1 is a plan view of a gusseted seamless bag, which can include two lap seals.

In FIG. 1, bag 10 has top 12, a bottom 14, left- and right-side gussets 16 and 16', respectively, with left- and right-side center gusset creases 18 and 18', respectively. Extending inward approximately {fraction (⅛)}" to ¼", or a little more, from left-side center gusset crease 18 are internal flap edges 20 and 22 (the latter not shown as it lies directly underneath internal flap edge 20). Internal lap-sealed portion 24 (shaded portion) is the narrow strip of material that lies in between left-side center gusset crease 18 and internal flap edges 20 and 22 and runs continuously from bag top 12 to bottom 14. As viewed, the lap-sealed portion 24 lies inside of bag 10 adjacent to left-side center gusset crease 18, and the lap seal defining left-side center gusset crease 18. With the lap seal facing inward, inside the bag, the outer surface of the bag has no ridges or seals pointing outward, as would be the case with prior art.

Figure 2:
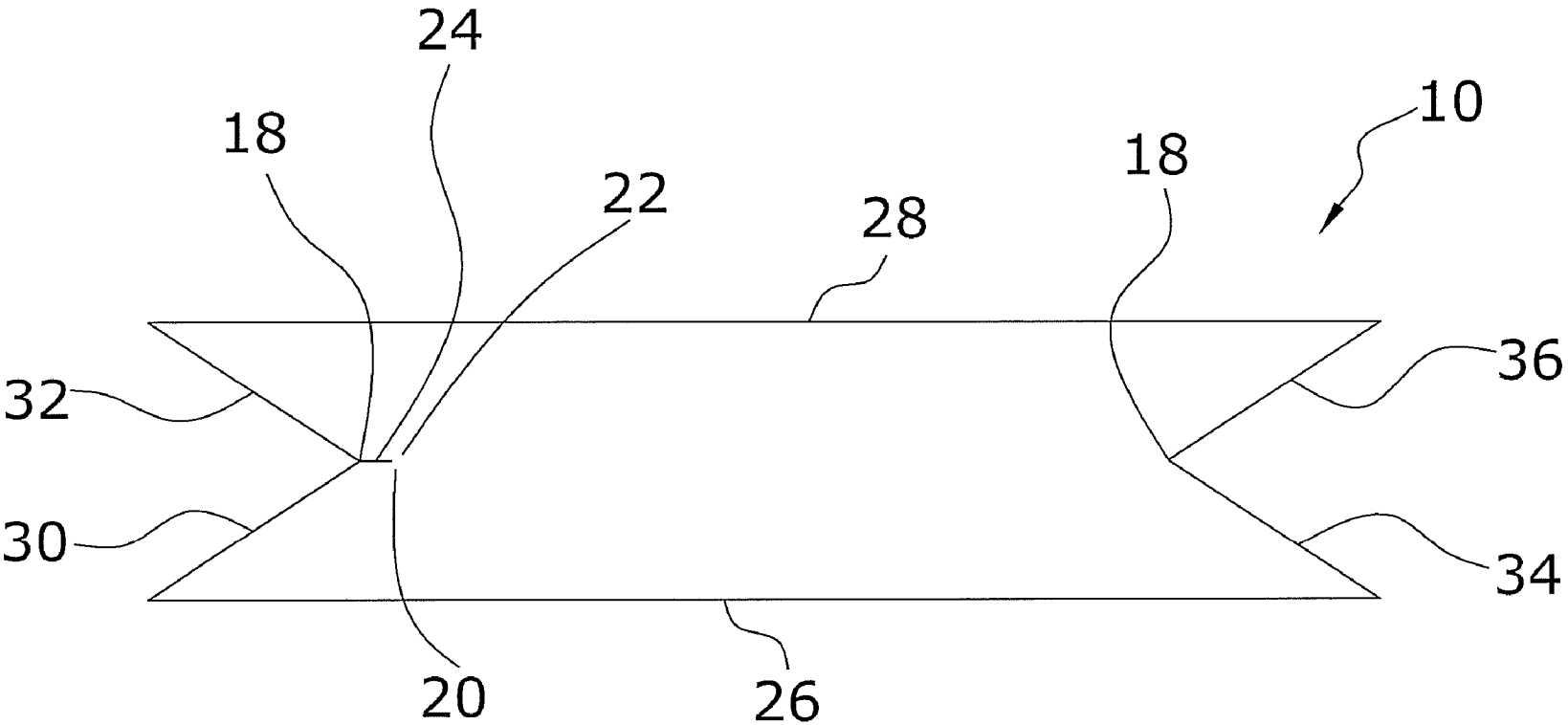
FIG. 2 is a blown-up cross-sectional view of the gusseted film in the bag of FIG. 1

In FIG. 2, bag 10 is illustrated as having a front panel 26, a rear panel 28, a left-front-side gusset panel 30, a left rear side gusset panel 32, a left-side center gusset crease 18, a right-front-side gusset panel 34, a right rear side gusset panel 36 and a right-side center gusset crease 18'. In between left-side center gusset crease 18 and internal flap edges 20 and 22 is internal lap-sealed portion 24. This lap-sealed portion may be a strip as narrow as ⅛" or may be wider. For the economy of using fewer raw materials, the narrow seal is preferred, unless of course, a wider, stronger seal were preferred due to heavier contents. It is easy to see that with the lap seal's disposition being inside the bag, the outer surfaces appear to be seamless, with no outwardly protruding edges or seals. Lap sealing in this method naturally produces a center gusset crease, albeit, the crease may also be positioned elsewhere on the bag, for instance, on the right-side gusset or on a front or rear panel.

Figure 3:
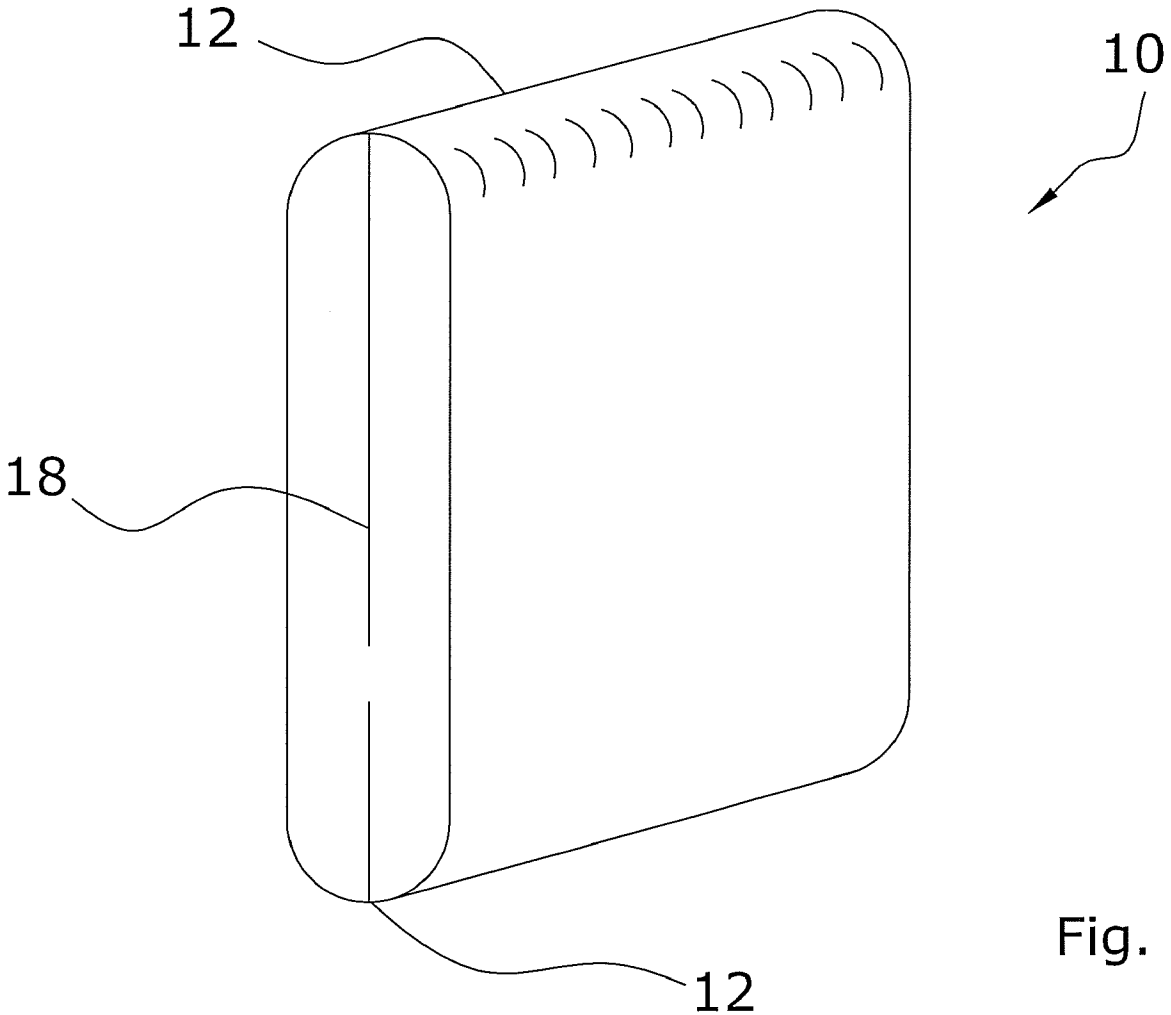
FIG. 3 is a perspective view of the bag in FIG. 1 with contents inside.

In FIG. 3 bag 10 has been filled with a flowable material and sealed at the top edge 12. Left-side center gusset crease 18 is one continuous crease formed by the internal lap-sealed portion 24 (the latter not shown since it is inside bag 10). The outer appearance of center gusset crease 18 looks much like that of any other side gusset crease commonly seen in standard tube-type bags, that is, one clean, continuous fold.

Figure 4:
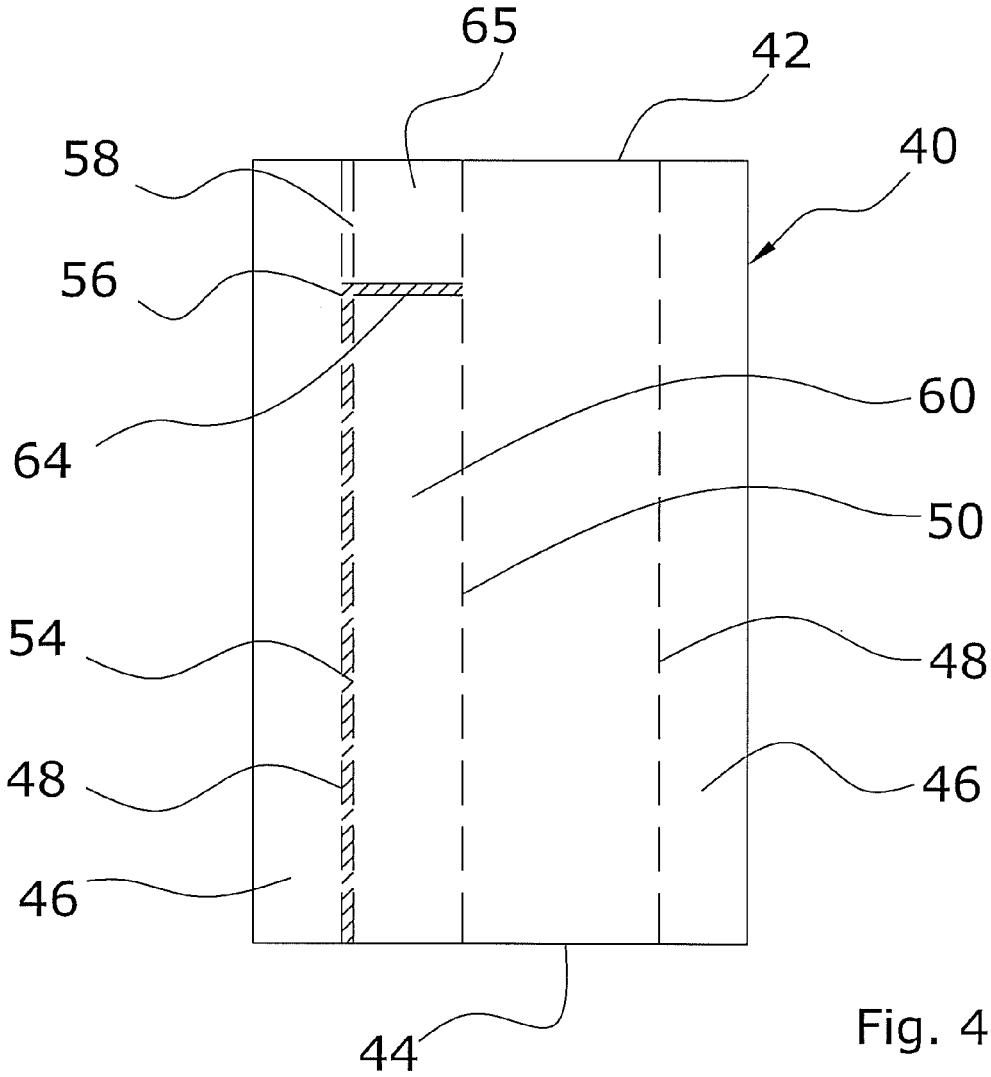
FIG. 4 is a plan view of a valve bag of the present invention.

In FIG. 4 bag 40 has atop 42, a bottom 44, left- and right-side gussets 46 and 46', respectively, with left- and right-side center gusset creases 48 and 48', respectively. Both bag top 42 and bottom 44 are sealed forming bag 40 into a pillow-like bag when filled. Extending inward from left-side center gusset crease 48 are internal flap edges 50 and 52 (the latter not shown as it lies directly underneath internal flap edge 50). Internal lap-sealed portion 54 (shaded portion) is a narrow sealed strip that lies adjacent to left-side center gusset crease 48 and spaced from internal flap edges 50 and 52, but runs continuously only from bag bottom 44 up to point 56, where it stops. Valve opening 58 is the unsealed portion that lies along left-side center gusset crease 48 in between point 56 and bag top 42, and is suitable for allowing entry of a fill nozzle much like those used to fill standard paper valve bags. With valve opening 58 positioned at the center gusset crease, it is easy and natural for the user to find the valve opening 58 of bag 40 and mount it on a fill nozzle. In between lap-sealed portion 54 and valve opening 58, and internal flap edges 50 and 52, lie internal flap portions 60 and 62 (the latter not shown as flap portion 62 lies directly under flap portion 60) that run continuously from bag top 42 to bag bottom 44. Typically, internal flap portions 60 and 62 may extend inward, inside bag 40, about 2" to 3" depending upon bag size, but could certainly be more or less. Horizontal seal 64 begins at point 56 and runs approximately horizontally into internal flap portions 60 and 62. The area in between horizontal seal 64 and sealed bag top 42 forms a valve sleeve 65, which sleeve, along with valve opening 58, typically measures about the same overall circumference, or slightly greater, as an existing prior art fill nozzle. Thus, valve opening 58 and valve sleeve 65 may be mounted onto a fill nozzle with a reasonably snug fit, preventing leakage as the bag is filled, and subsequently collapsing upon itself after filling, so that the flowable material contained inside will not leak out. The intention of the present invention is not to specify the width of the internal flap portions that allow the formation of a valve sleeve, but to illustrate the concept as one that is viable with present day flowable filling machinery that use fill nozzles. The internal flap portion as shown is an integral portion of the same sheeting that has formed the internal flaps and the bag. It may also be accomplished by inserting a separate internal flap portion and sealing it to the bag top and to the internal lap seal 54 below point 56. Or, it may even be accomplished in much the same way, but with an external lap seal instead of an internal lap seal. Either manner could serve the same purpose. However, having the internal portion as a continuous part of the sheeting is the preferred manufacturing process, even though it requires using a bit more film and a bit more raw material. This manufacturing process may be improved upon by cutting away the unused internal flap portions that lie below the horizontal seal 64 and recycling that unused portion.

Figure 5:
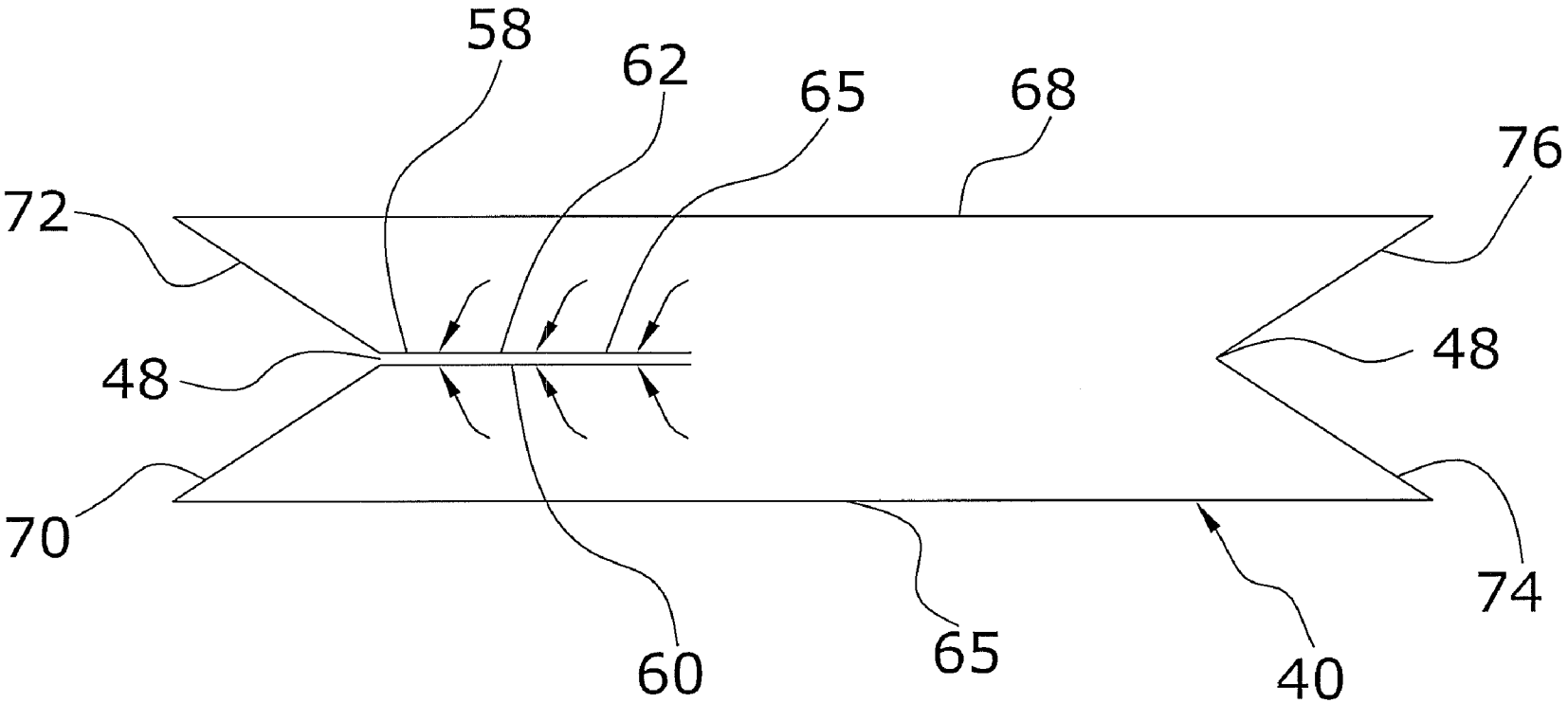
FIG. 5 is a cross-sectional view of the gusseted film in the bag of FIG. 4.

In FIG. 5, bag 40 is illustrated as having a front panel 66, a rear panel 68, a left-front-side gusset panel 70, a left rear side gusset panel 72, a left-side center gusset crease 48, a right-front-side gusset panel 74, a right rear side gusset panel 76 and a right-side center gusset crease 48'. In between left-side center gusset crease 48 and internal flap edges 60 and 62 is valve opening 58. The internal lap-sealed portion 54 is not shown as it lies directly below open valve portion 58 and is much like that of internal lap seal 24 of FIG. 2 in that it may be a strip as narrow as ⅛" or wider. Valve sleeve 65 lies inward of valve opening 58. Horizontal seal 64, though not shown, defines the lower extremity of valve sleeve 65. As shown valve sleeve 65 is made from integral portions of internal flap edges 60 and 62. Alternatively, it may be an attached sleeve portion sealed to a top edge and the internal lap seal as described in FIG. 4.

Figure 6:
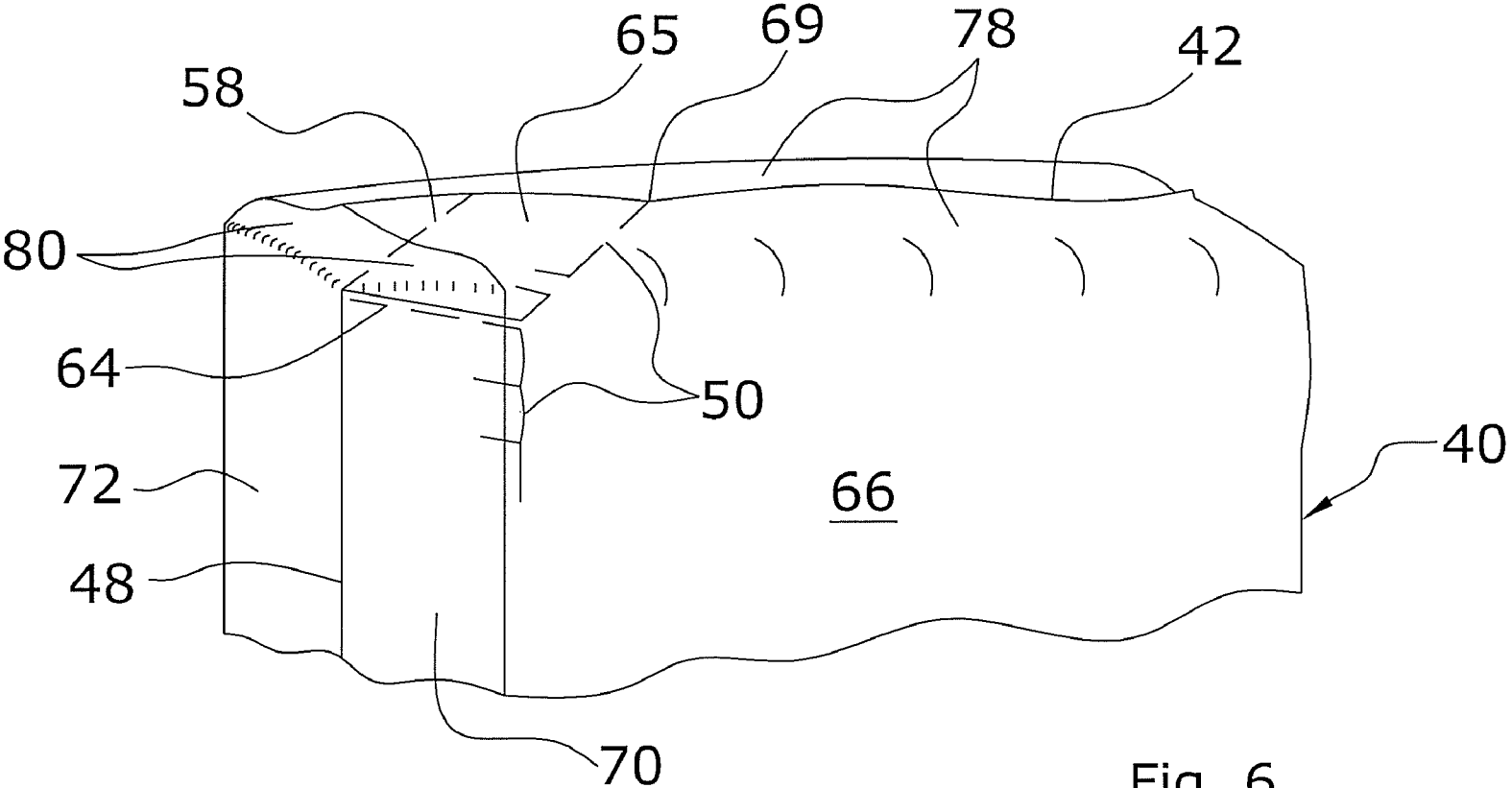
In FIG. 6 bag is a perspective view of the top portion of the bag in FIG. 3 after being filled and illustrating the closure of the valve sleeve.

In FIG. 6, the top of bag 40 has been filled with flowable contents and takes on its natural parallelepiped or cubic disposition predetermined, in the most part, by the bag's dimensions. As seen, bag 40 includes a sealed top 42, a front panel 66, a left-front-side gusset panel 70, a left rear side gusset panel 72 and a left center gusset crease 48, which is in an unfolded disposition since bag 40 is filled with flowable contents. Upon filling with flowable contents, bag 40 has formed a top 78, which is made up of the two upper portions of front panel 66 and rear panel 68 (see FIG. 5), with valve opening 58 now positioned inside the upper folded left-side gusset region 80 and closed off. Upon filling with contents, valve sleeve 65 closes back upon itself into a layflat configuration, thus not allowing the flowable contents to escape, or leak out. The formation into a cubic disposition causes valve sleeve 65 to close upon itself and also to pull downward and outward thus causing a small stress dimple 69 at the junction of bag top 42 and internal flap edges 50 and 52 (not shown). Once palletized, bag 40 would be placed flat upon rear panel 68, thus making top 78 an "end" of the rectangular cube. It is important to note that the closure phenomena explained herein is even stronger in its palletized disposition since the pressure from the contents pushes outward on the valve sleeve, creating a more secure closure of the valve sleeve and valve opening.

Figure 7:
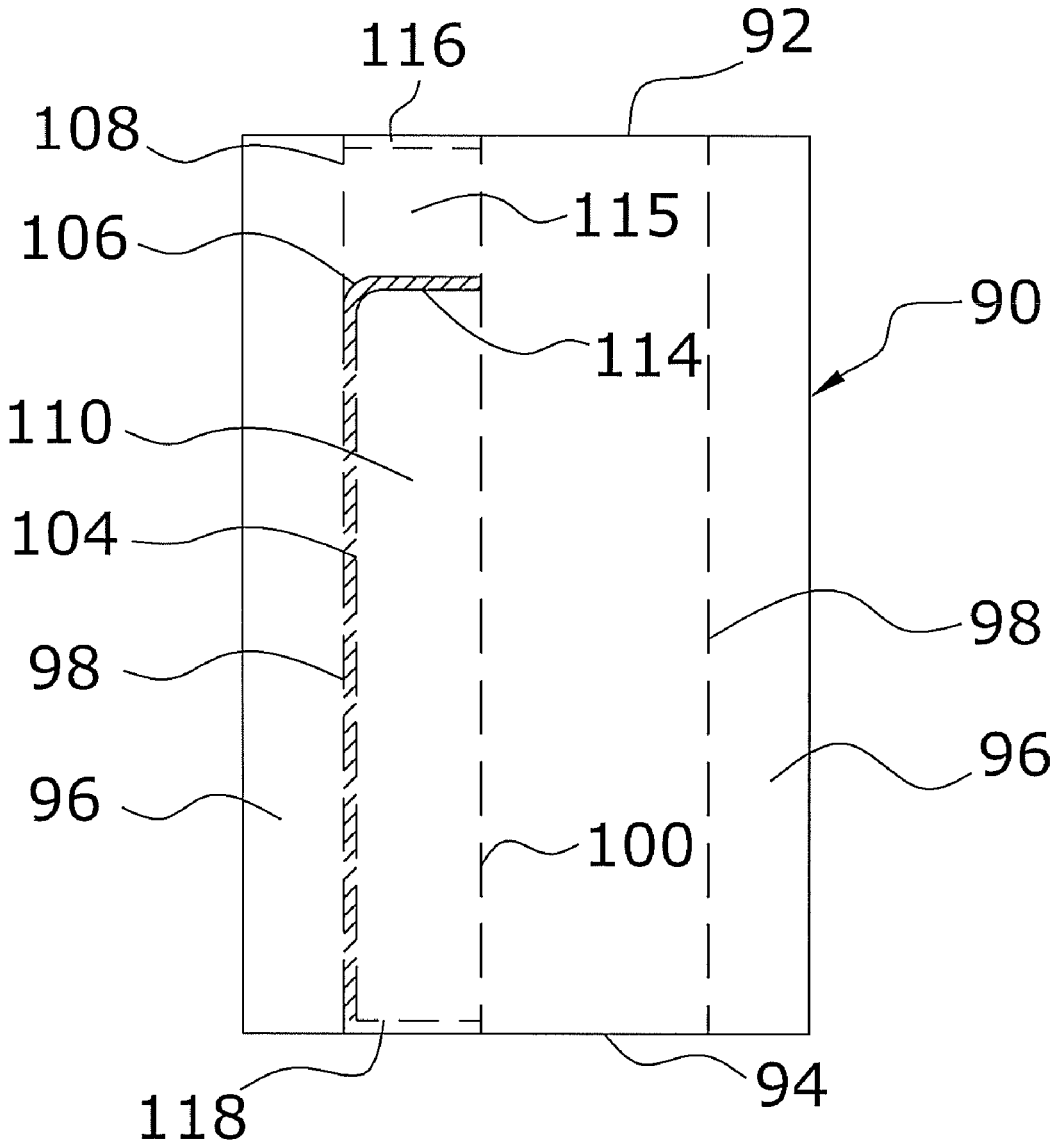
FIG. 7 is a plan view of a valve bag in which the valve doubles as a pour spout and also showing an anti-dimpling effect at the bag bottom.
Figure 8:
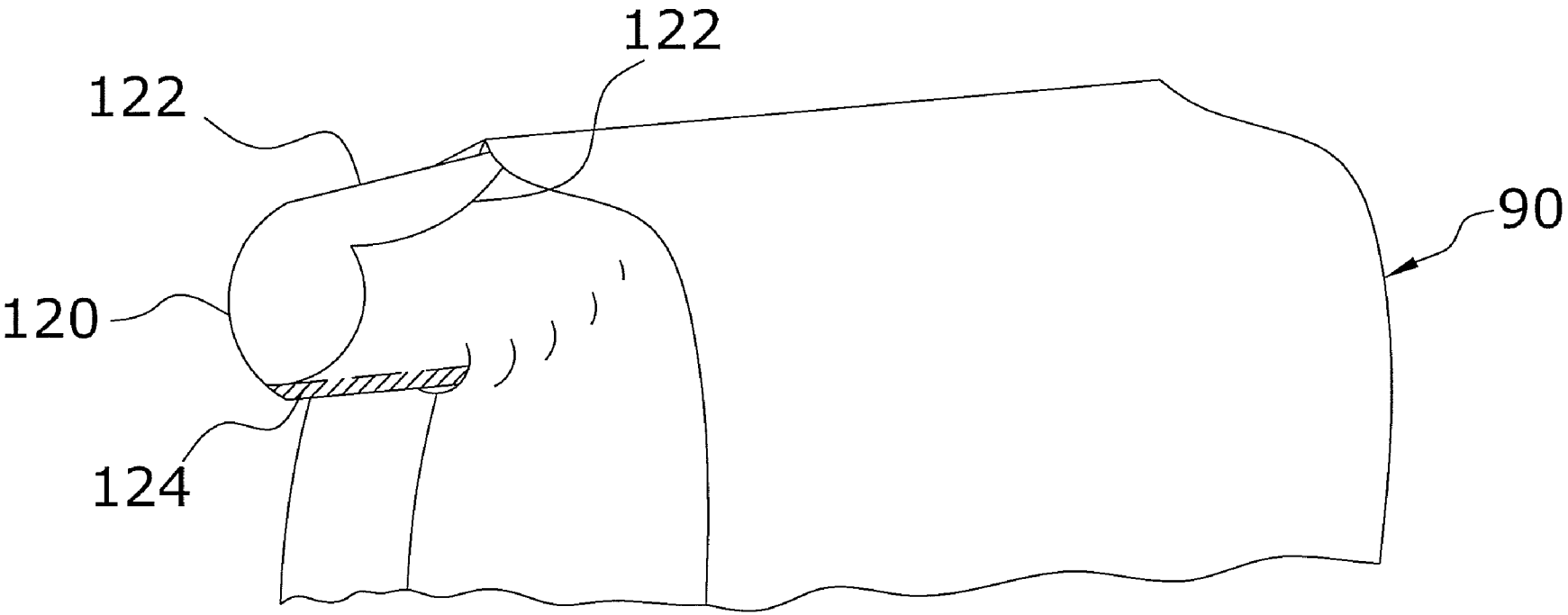
FIG. 8 is a perspective view of the bag in FIG. 7 with the pour spout pulled out.

In FIG. 7, the structure of bag 90 is much like that of bag 40 in FIG. 4 with a top 92, a bottom 94, left- and right-side gussets 96 and 96', respectively, with left- and right-side center gusset creases 98 and 98', respectively. Both bag top 92 and bottom 94 are sealed forming bag 90 into a pillow-like bag when filled. Extending inward from left-side center gusset crease 98 are internal flap edges 100 and 102 (the latter not shown as it lies directly underneath internal flap edge 100). Internal lap-sealed portion 104 (shaded portion) is a narrow sealed strip that lies adjacent to left-side center gusset crease 98 and spaced from internal flap edges 100 and 102, and runs continuously from bag bottom 94 up to point 106, where it stops. An improvement is made at point 106 by rounding the lap-sealed edge as it joins horizontal seal 114, thus eliminating a potential stress location and also making valve opening 108 easier to mount on a fill nozzle. Valve opening 108 lies along left-side center gusset crease 98 in between point 106 and bag top 92, and is suitable for allowing entry of a fill nozzle much like those previously described. In between lap-sealed portion 104 and valve opening 108, and internal flap edges 100 and 102, lie internal flap portions 110 and 112 (the latter not shown as flap portion 112 lies directly under flap portion 110) that run continuously from bag top 92 to bag bottom 94. Beginning at point 106 and running approximately horizontally into the internal flap portions 110 and 112, is horizontal seal 114 defining valve sleeve 115, which in combination with valve opening 108, is mountable on a fill nozzle. Top perforation line 116 is located on internal flaps 110 and 112, near the top of valve sleeve 115, adjacent to bag top 92, and bottom perforation line 118 is located near the bottom of internal flap portions 110 and 112 adjacent to bag bottom 94. Top perforation line 116 is sufficiently easy to tear so that a user may reach in and pull outward on the prefabricated valve sleeve 115, thus forming a pour spout as illustrated in FIG. 8. Top perforation line 116 also serves to eliminate the stress dimple (shown as 69 in FIG. 6) at the top region, when it tears free upon filling with flowable contents. Likewise, when bottom perforation line 118 tears free upon filling with flowable contents, there will be no stress dimple along the bottom sealed edge either. Stress dimples do not appear to affect the integrity of the bag strength quality in most applications, but might if the bags were filled with extremely heavy contents and the internal flaps extend far into the bag. In other words, the narrower the internal flap, the less significant the stress dimple. Using perforations at the top and bottom regions of the internal flaps and eliminating the stress dimples also improves the outward appearance, since there is no distortion along a top or bottom sealed edge. Alternatively, creating a top pour spout or eliminating stress dimples can be achieved by placing cut lines on the internal flaps instead of top or bottom perforations. A perforation line also doubles as a means to maintain the integrity of the web of film as it moves along in the manufacturing process, whereas a cut line may tend to allow some web distortion. The perforation or cut line may also extend outward, past the internal flap and into the gusset panels to the outermost bag edges With this design, the spout tends to become larger.

In FIG. 8, bag 90 is filled with flowable contents and sits upright much like the bag in FIG. 6. Valve sleeve 115 has been pulled outward and perforation line 116 (see FIG. 7) has severed, forming pour spout 120. Pour spout 120 was valve sleeve 115 when in its internal position (see FIG. 7), and is defined by top edges 122 and 122', and a bottom edge 124. Top edges 122 and 122' were the edges of valve sleeve 115 at perforation line 116 when the sleeve was in its internal position. Bottom edge 124 is horizontal seal 114, which has been extracted from the interior of the bag to form a pour spout base. The pour spout size is determined by the overall height (or size) of the valve sleeve. Valves used in many common nozzle filling applications are about 4" to 4.5" in circumference, and when pulled out to form a spout, make a workable pour spout. Pull-out pour spouts as defined herein also include those that are part of an internally attached portion that is not part of an internal flap.

Figure 9:
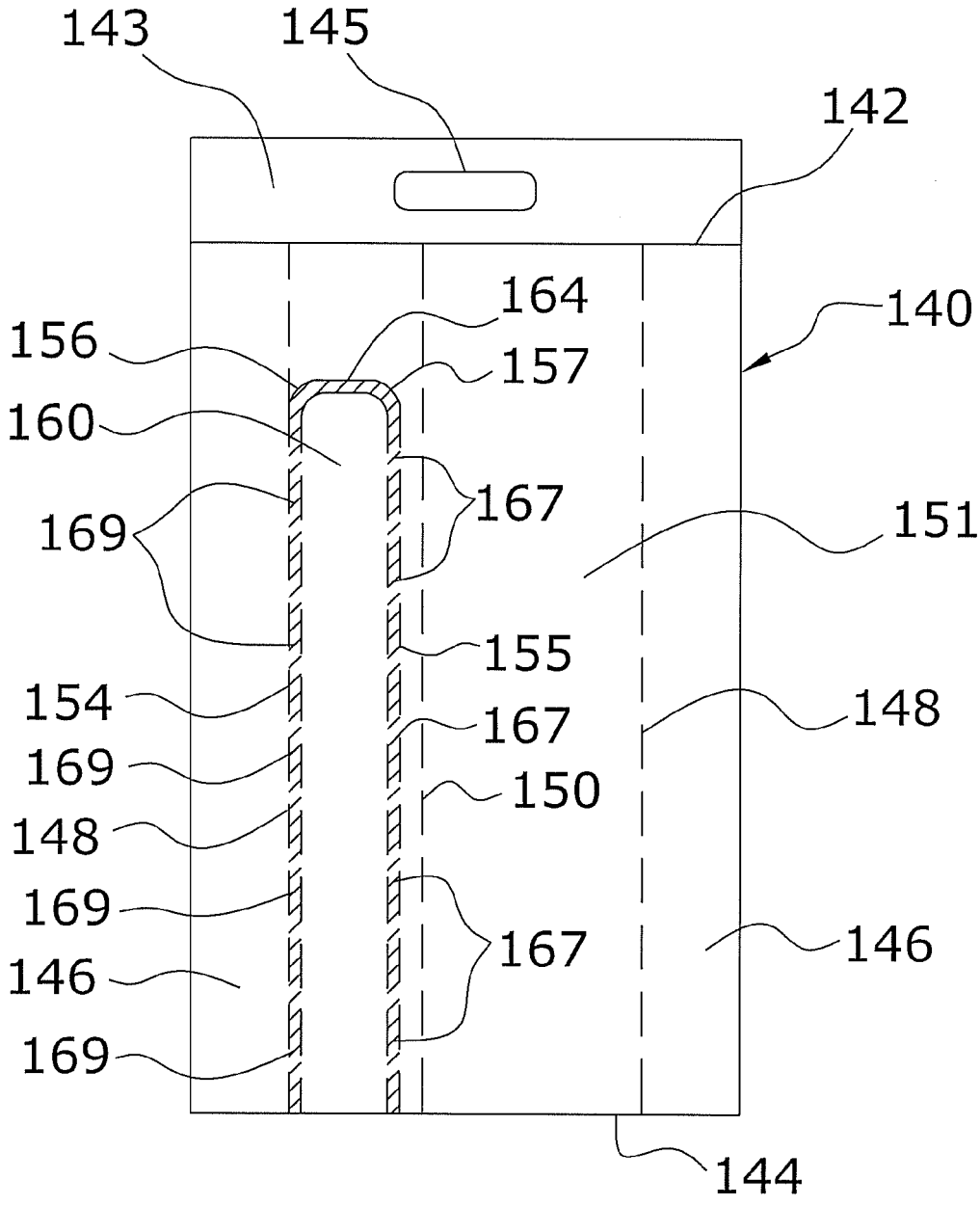
FIG. 9 is a plan view of the bag in FIG. 7 with an air ventilation system along the internal flap and with a die-cut handle.

In FIG. 9, bag 140 is much like those in FIG. 4 and FIG. 7 with a top 142, a bottom 144, left- and right-side gussets 146 and 146', respectively, and left- and right-side center gusset creases 148 and 148', respectively. Both bag top 142 and bottom 144 are sealed, forming bag 140 into a pillow-like bag when filled. Extending above bag top 142 are handle portions 143 and 147 (the latter not shown because it lies directly underneath handle portion 143), which portions have centrally located die-cut handles 145 and 149 (also not shown because die cut 149 is cut upon handle portion 147 and lies directly below die cut handle 145). Handle portions 143 and 147 are contiguous sections of film connected to front panel 151 and rear panel 153 (the latter not shown because it lies directly below front panel 151). Extending inward from left-side center gusset crease 148 are internal flap edges 150 and 152 (the latter not shown because it lies directly underneath internal flap edge 150). Internal lap-sealed portion 154 (shaded portion) is a narrow sealed strip that lies adjacent to left-side center gusset crease 148, is spaced from internal flap edges 150 and 152, and runs continuously from bag bottom 144 up to point 156, then stops. A second internal lap-sealed portion 155 is adjacent to internal flap edges 150 and 152, is spaced from left-center gusset crease 148, runs parallel to lap-sealed portion 154, and ends at point 157 where it joins horizontal seal 164. Throughout second internal lap-sealed portion 155 are intermittent breaks 167 in the seal to allow air passage. These breaks typically are as narrow as {fraction (1/32)}" to as great as ¼". In addition, intermittent breaks 169 are positioned throughout internal lap-sealed portion 154. In between internal lap-sealed portion 154 and second internal lap-sealed portion 155 lies a mostly sealed-in internal region 160 created by the internal flaps themselves, bounded by four seals-bottom seal 144, internal lap seals 154 and 155 and horizontal seal 164 with breaks at 167 and 169 as previously described. When bags of the present invention are filled with flowable materials, it may be desirable to have a means to allow entrapped air to escape from portions other than the valve sleeves and valve openings. Thus, breaks 167 in second internal lap seal 155 allow air to escape into the sealed-in internal region 160 and, subsequently, out through breaks 169 in lap seal 154. This is a tortuous path because sealed-in internal portion 160 is collapsed upon itself. Such a tortuous path is desirable in many cases since it will help prevent, or completely eliminate leakage of the flowable contents. A tortuous path may also be created by having perforation holes in the mostly sealed-in portion instead of having breaks in second lap seal 155. In such a bag, the handled top is suitable for carrying and transporting as well as serving as a means to assist in pouring flowable Contents from the pour spout (as illustrated in FIGS. 7 and 8). It may be made in any variety of styles and sizes. While not essential, the air relief means serves as a means of allowing air trapped inside during the filling process to escape from inside the bag, and allows the bag to breathe in order to avoid condensation build-up.

Figure 10:
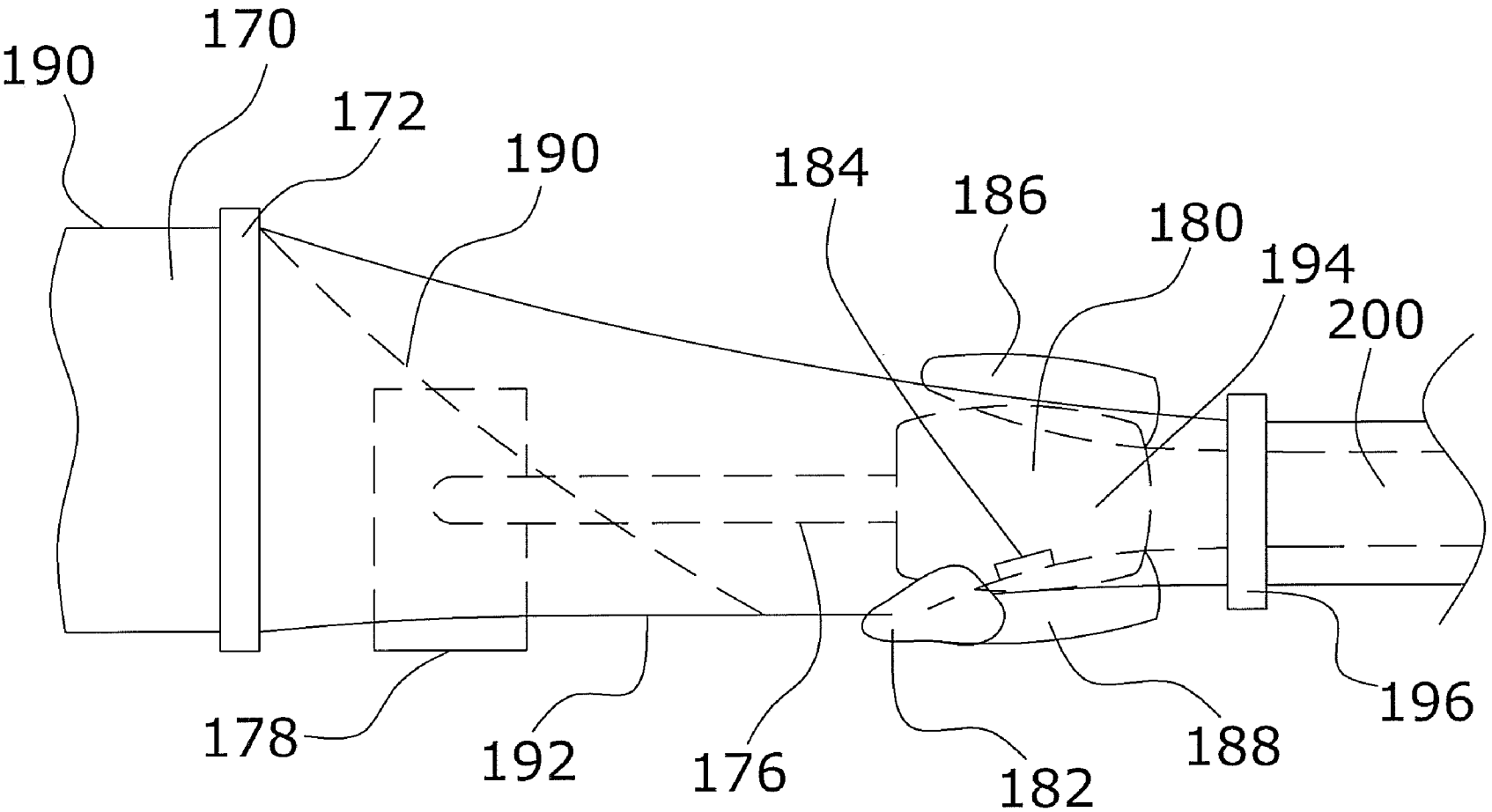
FIG. 10 is a top perspective view of the cantilevered manufacturing process.

In the top view of FIG. 10, layflat film sheet 170 moves between rollers 172 and 174 (the latter not shown because it lies directly under roller 172). The pressure exerted between rollers 172 and 174 holds film 170 in its layflat disposition. Upon leaving rollers 172 and 174, layflat sheet 170 begins a fold-over process as it wraps around cantilever arm 176. Cantilever arm 176 is secured to base 178 and protrudes forward toward the tube-to-be-formed, which, at its extremity, is mounted with an internal former 180, an edge turning device 182 and internal lap sealer 184. Two gusseting fins 186 and 188 are located on the outside of former 180. As layflat sheet 170 folds over, which is accomplished by any number of prior art means, film edge 190 turns under until it is matched with film edge 192. The edges move together into edge turning device 182, thus turning the two matched film edges 190 and 192 inward, pointing inside the tube-to-be-formed. The two inside film edges 190 and 192 then move to internal lap sealer 184, are sealed together in an internal disposition and, as may be required for the various bag styles previously discussed, may include the interruption of seals to create valve openings or air relief breaks. At location 194 a tube has been formed from the film, and the gusseting operation is completed by the internal former 180 and the two external gusset fins 186 and 188, as the film passes by. Rollers 196 and 198 (the latter not shown because it lies directly under roller 196) maintain the newly gusseted film 200 in its predetermined gusseted disposition for further processing downstream.

The forming of the tube to create two turned-in matched edges for further internal lap sealing, may be accomplished in a number of ways. The novelty of what is revealed herein is not the exact methodology of doing this, but the requirement to do so on a cantilevered means. Internal formers are known in prior art, but have not been used in accordance with a cantilever process as described herein. The internal forming operation, may be achieved by the internal former being an integral part of the cantilever/lap sealing system, or the internal former may be independent of the sealing operation. But the internal sealing must be accomplished in a cantilevered fashion, regardless of whether the cantilever extends out 5 inches or 5 feet.

Figure 11:
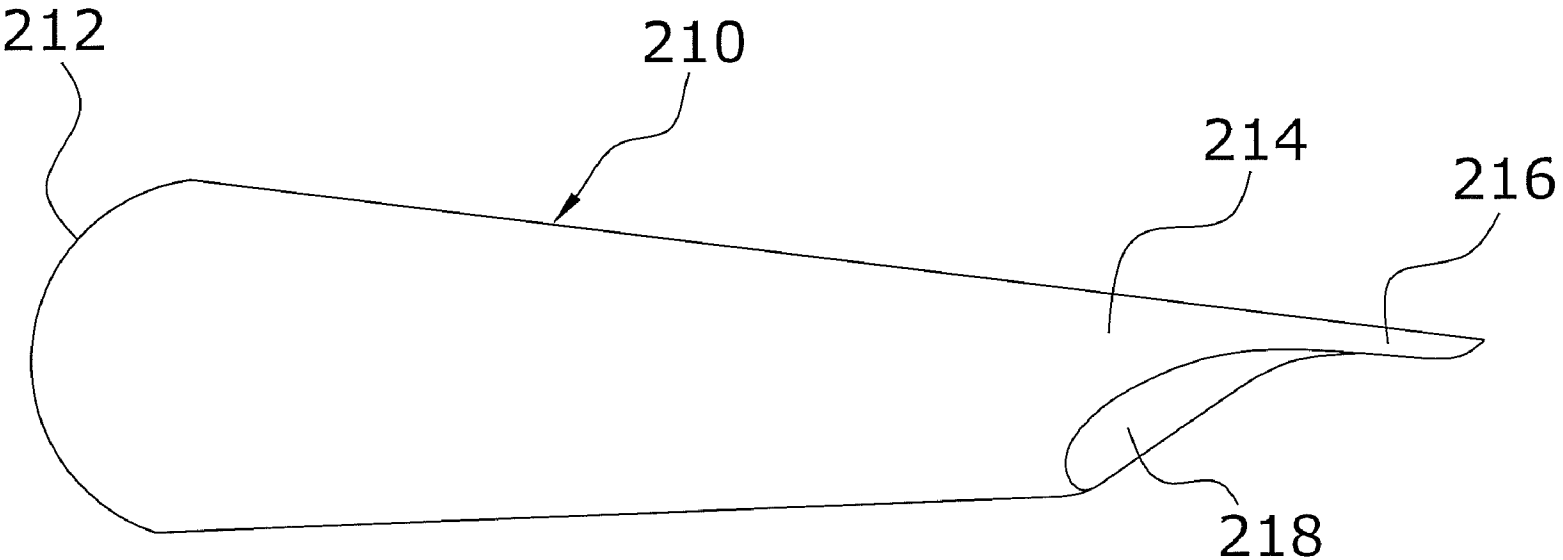
FIG. 11 is a perspective view of a tapered fill nozzle of the present invention.

In FIG. 11, tapered fill nozzle 210 is an extended hollow tube connected to the filling equipment (not shown) at its rear entry point 212. The front tube portion 214 of fill nozzle 210 tapers to a smaller diameter than at rear entry point 212, and ends with a pointed tip 216, suitable for easy insertion into a valve bag. Exit point 218, from which flowable material will flow into a bag when mounted on fill nozzle 210, is set back from pointed tip 216. Typically this type of fill nozzle has about a 2"-2.5" ID and is about 18" long for concrete products filling applications. The nozzle may be substantially smaller for small bags, or substantially larger for larger bags or bulkier flowable materials. For durability, fill nozzles are usually made of steel, but may be made of most any other type of material, such as plastic or aluminum, that can be formed into a tubular shape. As will be illustrated, the use of a tapered fill nozzle may include a nozzle that is tapered only along the front portion, a mid portion or a rearward portion, depending upon how far onto the fill nozzle a bag is to be mounted.

Figure 12:
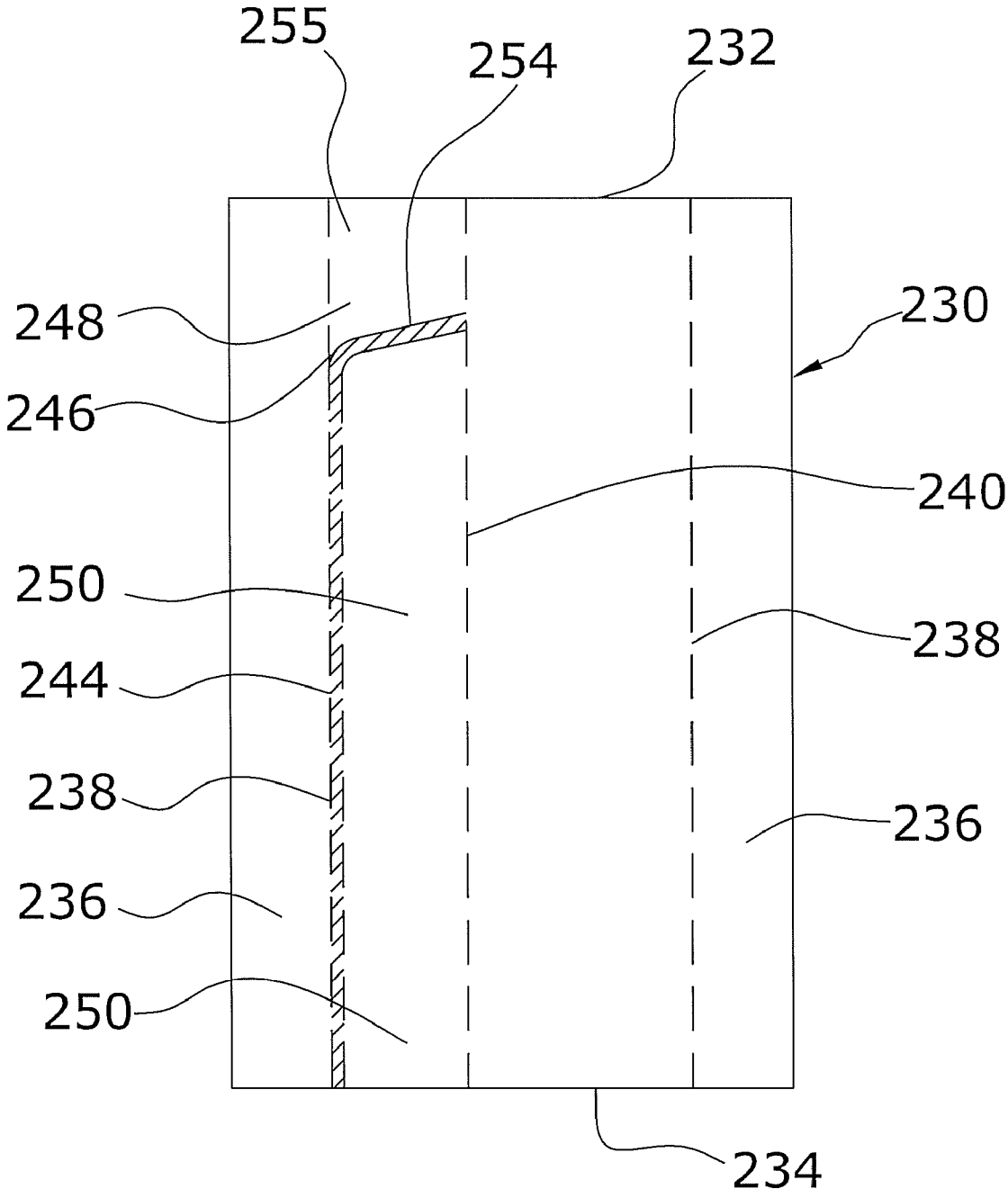
FIG. 12 is a plan view of a valve bag similar to that of the bag of FIG. 1.

In FIG. 11, valve bag 230 has a top 232, a bottom 234, and left- and right-side gussets 236 and 236', respectively, with left- and right-side center gusset creases 238 and 238', respectively. Both bag top 232 and bottom 234 are sealed forming bag 230 into a pillow-like bag when filled. Extending inward from left-side center gusset crease 238 are internal flap edges 240 and 242 (the latter not shown because it lies directly underneath internal flap edge 240). Internal lap-sealed portion 244 (shaded portion) is a narrow sealed strip that lies adjacent to left-side center gusset crease 238 is spaced from internal flap edges 240 and 242, and runs continuously only from bag bottom 234 up to point 246, then stops. Valve opening 248 is the unsealed portion that lies along left-side center gusset crease 238 in between point 246 and bag top 232, and is suitable for allowing entry of the fill nozzle shown in FIG. 12. In between lap-sealed portion 244 and valve opening 248, and internal flap edges 240 and 242, lie internal flap portions 250 and 252 (the latter not shown because flap portion 252 lies directly under flap portion 250) that run continuously from bag top 232 to bag bottom 234. Typically, internal flap portions 250 and 252 extend inward about 2" to 3" inside bag 230, depending upon bag size, but could certainly extend to a greater or lesser depth. Beginning at point 246 and running approximately horizontally, but tapering upward into the internal flap portions 250 and 252 is horizontal tapered seal 254. The area in between horizontal seal 254 and sealed bag top 232 forms a tapered valve sleeve 255, which sleeve along with valve opening 248 snugly fits around the front tapered portion 214 of the fill nozzle of FIG. 11. Valve opening 248 and valve sleeve 255 may be mounted onto a standard fill nozzle with a snug fit, or onto a tapered fill nozzle such as that of FIG. 1 with an even greater secure, snug fit, thus preventing the flowable material from spilling out during the filling process (which is frequently a high-pressure operation). This tapered fit also keeps air and its accompanying flowable material dust particles from escaping, such as that which accompanies cement and concrete byproducts. A tapered valve sleeve as described herein clearly works best in combination with a tapered fill nozzle, as it will seat itself along the entire valve surface to the tapered nozzle surface underneath. However, the tapered valve sleeve is also an improvement when used with existing non-tapered fill nozzles.

Figure 13:
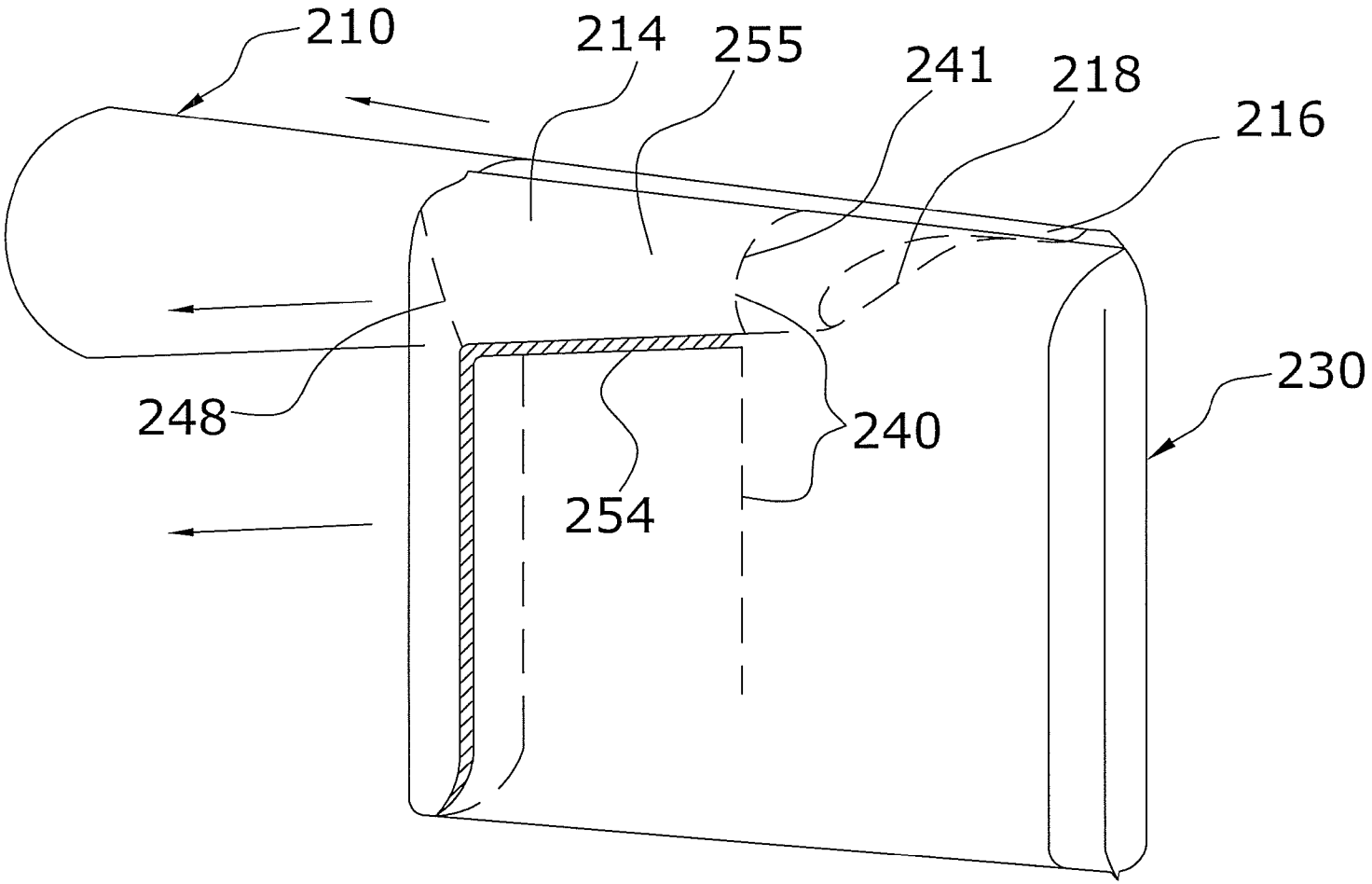
FIG. 13 is a perspective view of the bag in FIG. 12 snugly mounted on the tapered fill nozzle of FIG. 11.

In FIG. 13, bag 230 is mounted onto fill nozzle 210 by pulling valve opening 248 over pointed tip 216, pulling forward (direction of arrows) and seating valve sleeve 255 securely on tapered front tube portion 214 (as illustrated now lies directly under valve sleeve 255). The tapered valve sleeve 255 of the present invention will typically be tapered at the same degree as the tapered fill nozzle front portion, which means both would have about the same circumference dimensions at any given point along the valve sleeve or fill nozzle, once the valve sleeve has been mounted on the fill spout. These matching tapers provide an extremely tight fit and can virtually eliminate the escape of even the smallest dust particles. As shown, horizontal tapered seal 254 provides the matched tapers that ensure the tight fit on front tube portion 214 so that the exit point 218 lies just past internal flap edge 240, which also defines the innermost edge of valve seal 255 at curved dotted line 241. When valve sleeve 255 is withdrawn from fill nozzle 210, it subsequently collapses upon itself, back into its layflat disposition, so that the flowable material contained inside will not leak back out. The intention of the present invention is not to specify the length and width of the tapered valve sleeve or the fill nozzle, but to illustrate the concept that the matched circumferences of the two tapered elements provide unique, valuable dynamics: 1) the superior securing of a tapered valve on a fill nozzle; 2) elimination of flowable material leakage during the fill process; and 3) elimination of dust contamination in the work environment.

Figure 14:
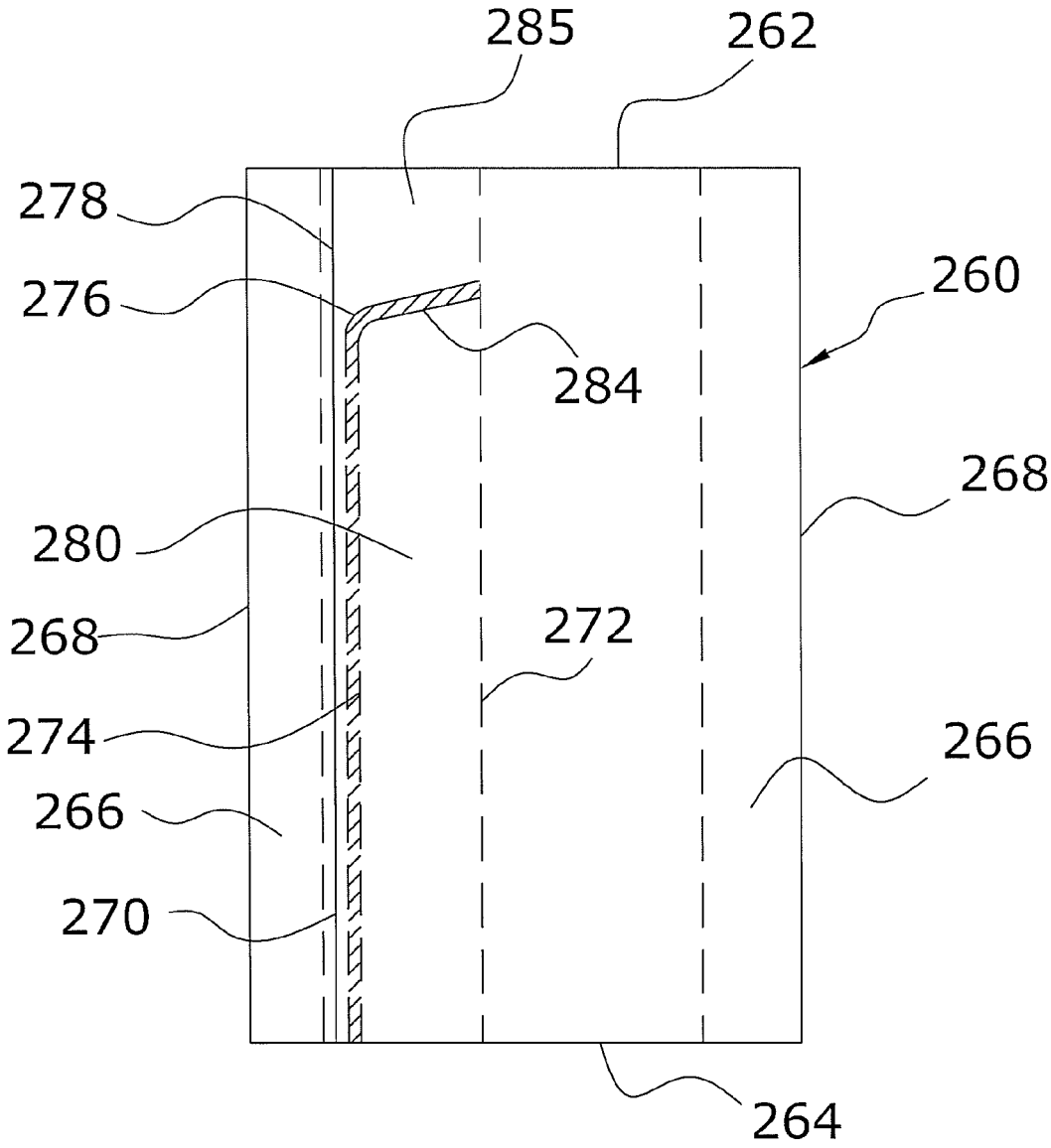
FIG. 14 is a plan view of a variation on a valve bag also suitable for mounting on the tapered fill nozzle of FIG. 11.

In FIG. 14, plastic valve bag 260 has a top 262, a bottom 264, and left- and right-side gussets 266 and 266', respectively, with left- and right-side outside gusset folds 268 and 268', respectively. Both bag top 262 and bottom 264 are sealed forming bag 260 into a pillow-like bag when filled. Situated in from the left-side outer gusset fold is an overlapping edge 270 that extends outward from internal flap edge 272. Overlapping edge 270 has all adjacent lap-sealed portion 274 (shaded portion), a narrow sealed strip that runs continuously from bag bottom 264 up to point 276, then stops. Valve opening 278, the unsealed portion of overlapping edge 270, lies in between point 276 and sealed bag top 262, and is suitable for allowing entry of a fill nozzle like that of FIG. 11. In between lap-sealed portion 274 and valve opening 278, and internal flap edge 272, lies external flap portion 280 and internal bag wall portion 282 (not shown because it lies directly below external flap portion 280). External flap portion 280 and internal bag wall portion 282 run continuously from bag top 262 to bag bottom 264. Typically, internal flap edge 272 extends inward from overlapping edge 270, about 2" to 3" (inside bag 260, depending upon bag size, but could certainly extend to a greater or lesser depth. Horizontal seal 284, begins at point 276 and runs approximately horizontally, but tapers upward into internal bag wall portion 282. The area between horizontal tapered seal 284 and sealed bag top 262 forms a tapered valve sleeve 285. The tapered sleeve, along with valve opening 278, typically measures about the same overall circumference, at any given point, as the circumference along the front tapered portion of a fill nozzle as described in FIG. 13. Thus, valve opening 278 and valve sleeve 285 mount onto fill nozzle 210 with a highly snug fit, much like that of the bag described in FIGS. 12 and 13, with the same results of setting a secure fit of the valve on the fill nozzle, preventing leakage of flowable materials during the filling process, and eliminating the escape of flowable material dust particles. Again, the intention of the present invention is not to specify the width of the internal bag wall portion or external flap portions that allow the formation of a valve sleeve, but to illustrate the concept as one that is viable with present day flowable filling machinery that uses fill nozzles.

Moreover, the location of the overlapping edge may be all the way out to the left-side outer gusset edge, or further inward. The overlapping edge may even be rotated about to be positioned on one of the inner gusset panels or at a center gusset crease. This type of valve may also be created by inserting a separate internal flap portion, or portions, and sealing it (or them) to a bag top (such as 262) and to a lap seal (such as 274 below point 276) In such a case there would be no need to have an internal bag wall portion. Either manner serves the same purpose. However, having the internal bag wall portion as a continuous part of the sheeting is the preferred manufacturing process for this style of bag. This manufacturing process may be improved upon by cutting away the unused internal flap portions that lie below the horizontal tapered seal 84 and recycling those unused portions. The use of this type of valve bag generally works well on the fill nozzle of the present invention. Valve bags of this variety with the valve openings positioned in the side gusset panels, and preferably at the center gusset crease, tend to be preferred overall as it is easier to find the valve opening and they have a stronger construction because the suspending of the bag and valve on the fill nozzle is more balanced and uses equal film material plies (two) on each side of the valve sleeve.

Figure 15:
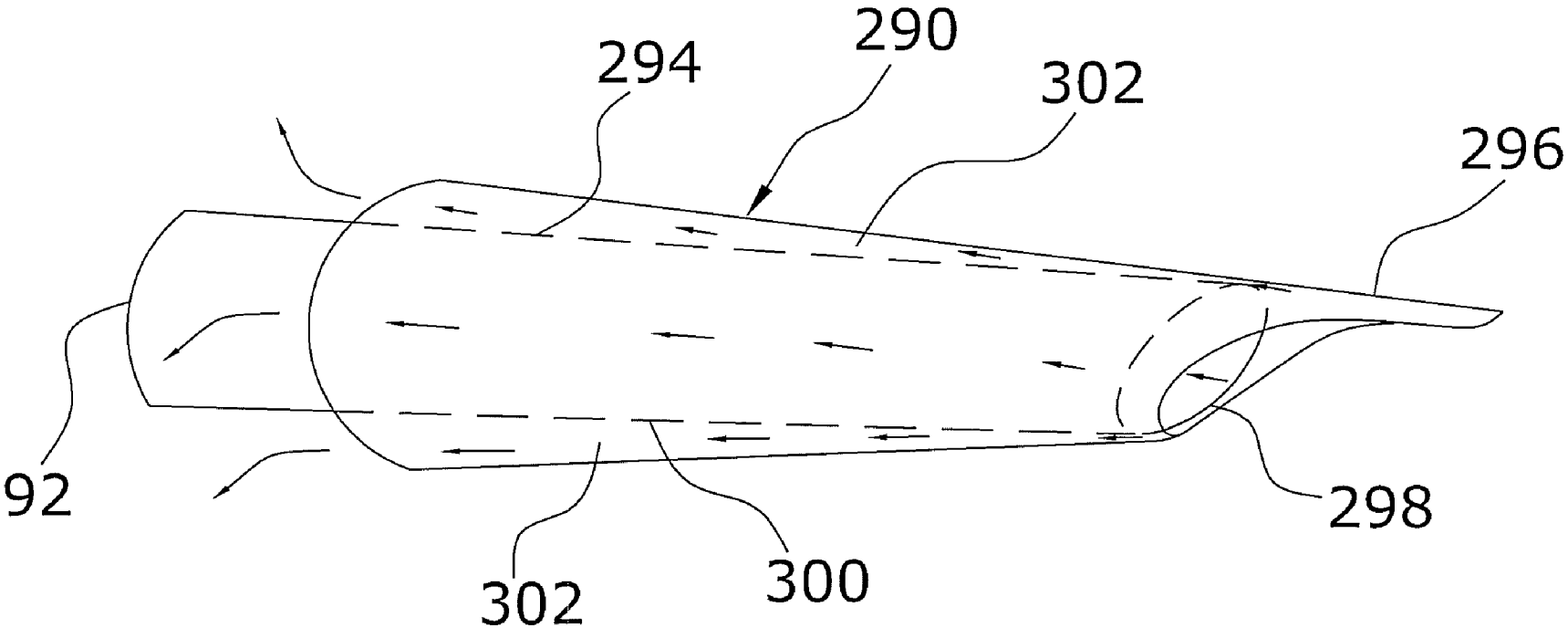
FIG. 15 is a perspective view of the tapered fill nozzle of FIG. 11 with an air relief system.

In FIG. 15, tapered fill nozzle 290 is similar to that of FIG. 11 and is an extended tube connected to the filling equipment (not shown) at its rear entry point 292. The front tube portion 294 of fill nozzle 290 is not tapered and ends at exit point 298, where flowable material flows into a subsequently mounted bag. Securely positioned around front portion 294 and exit point 298 is a second, larger, tapered tube 300 with a pointed tip 296, suitable for easy insertion into a valve bag. Air space 302, which allows the escape of air and dust upon pressurized filling operations, is located around the outer surface of front portion 294 and the inner surface of tapered tube 300. With a bag mounting on fill nozzle 290, as in FIG. 13, any entrapped air and its accompanying dust exits in the direction of the arrows, the venting being placed back and away from the location of the workers loading bags onto the nozzles. Typically this type of fill nozzle combination has about a 2"-2.5" ID and a length of about 18" for concrete products filling applications. This fill nozzle combination may be substantially smaller for small bags or substantially larger for larger bags or bulkier flowable materials. For durability, this combination could be made of steel, but may be made of most any type of material, such as plastic or aluminum, that can be formed into a tubular shape. The principle that is illustrated here is one that provides for an air escape so that during the filling process, any air that is used in the high pressure filling operations will not be captured and contained within the bag, such as happens in the fill processes typically used with cement and concrete products. With a high-pressure filling method in combination with the secure tight fit of the valve sleeve on a tapered nozzle, some form of air relief is desirable. The method of the invention primarily eliminates the need to have ventilation in plastic bags so that trapped air may subsequently escape. Further, the method directs the air and dust escape route backward into a concentrated area where it can be recaptured with a vacuum system and put back into the raw material silos. This concentrated air and dust escape means can also be accomplished by having an air relief tube inserted inside a fill nozzle, such as that of FIG. 11. Thus, the present invention provides a means of allowing for a concentration of air and dust to escape in a direction away from the front side of the nozzle where an individual is working as he/she mounts the bags and bag valves on the fill nozzle or is monitoring an automated process. For most applications having a high degree of dust levels and air pressure utilization in the fill process, this nozzle is the preferred version.

Figure 16:
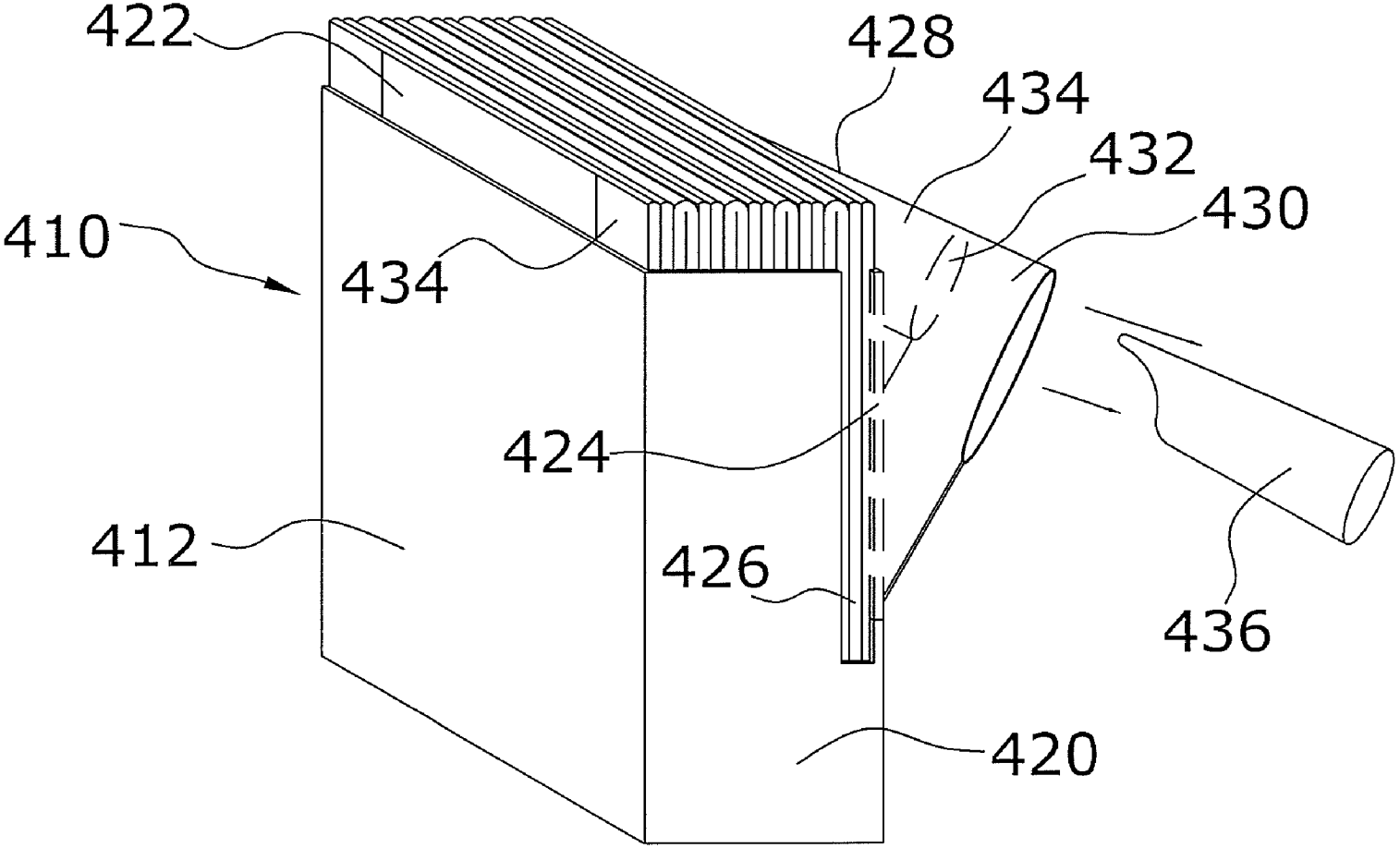
FIG. 16 is a perspective view of the bag in FIG. 12 mounted in a magazine feed system that enables the user to quickly mount the bag onto a fill nozzle.

In FIG. 16, magazine holder 410 has a left side 412, a right side 414 (not shown as it opposes left side 412), a bottom panel 416 (not shown), a front panel 420 and a rear panel 418 (not shown as it opposes front panel 420), with valve bag pack 422 (consisting of bags of one of the styles previously disclosed) set vertically within the magazine holder. Bag pack 422 is positioned within the magazine holder with all the underlying valve openings and valve sleeves registered inside the center gusset crease, (not shown) in the upper front corners 434. Adjacent to edge 424 and running substantially along front panel 420 is open slot 426 that allows for removal of a forward-most bag. As illustrated, forward-most bag 428 is partially extracted from magazine 410. Extracting a bag may be accomplished by several means. First, a worker may grasp forward-most bag 428 with his hand at the upper front corner 430, pull it forward (arrow direction) and out through open slot 426 and subsequently mount the underlying valve opening 432 and valve sleeve 434 on a nearby fill nozzle 436. Another means of extraction would be by the use of two suction cups that affix themselves to the front and rear bag panels (one to each panel) at the upper front corner 430 thus, grasping the opposing panels at the upper front corner 430. In combination, the two suction cups pull the side gusset panels slightly open and then pull the bag forward and onto the fill nozzle. Other grasping operations may be used as well; the general principle is to have bags mounted in a conveniently positioned magazine for subsequent manual or mechanical extraction. Furthermore, the magazine may be positioned at a slight tilt so that gravity causes the bags to stay in an upright disposition. Or, a simple spring-loaded plunger means may serve the same purpose. The magazine may also be loaded from the side instead of the top. In addition, the bags may be maintained in a horizontal disposition prior to being placed in a vertical disposition on a fill nozzle.

Figure 17:
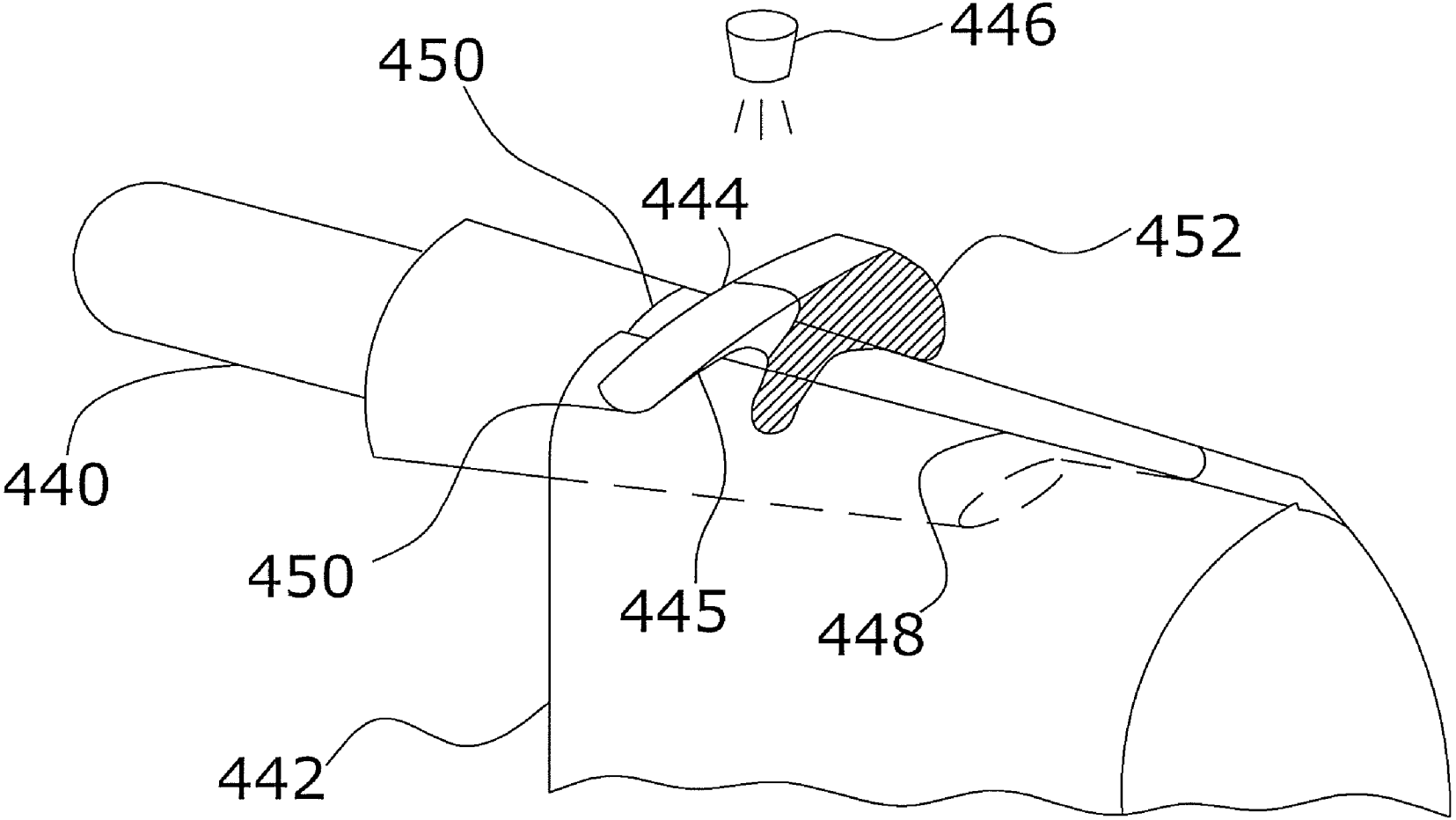
FIG. 17 is a perspective view of a tapered fill nozzle, with a mounted valve bag and a U-shaped bag retaining means.

In FIG. 17, tapered fill nozzle 440 has a valve bag 442 mounted thereon much like any of the bags and fill nozzles described herein. Bag 442 is held in place with pressure-actuated retaining means 444, which, when actuated by electric eye 446, moves downward, pins and maintains the secure fit of bag 442 on nozzle 440. Retaining means 444 is "U-shaped" at base 445 so it fits the contour of the bag on the fill nozzle and faces back at an angle, so that a worker may conveniently place his/her hands at the top of bag 442 at top forward point 448 while retaining means 444, when actuated, pins down bag 442 at top rear point 450 out of the way of a worker's fingers and hands. In front of retaining means 444 is safety stop 452 that prevents the workers fingers or hands from going past as he/she slides the bag 442 onto fill nozzle 440. Typically retaining means 444 is metal with a rubber base. The safety stop is made of a somewhat flexible material, such as a hard rubber.

The spirit of the present invention is to improve existing filling operations of flowable materials while enhancing dust control and improving productivity. Without question, there could be variations and modifications that may be considered, all of which would be considered as falling under the scope of the present invention.

As of the time of the filing of this PCT application, actual bags incorporating the invention have been built. Typical lay flat dimensions of this bag include a 10 inch width and a 21 inch length. On the side opposite the opening, the bag has a 2-inch inwardly extending seam. On the side having the opening, the bag has a 5-inch seam. The aperture of the bag is about 5 lineal inches in the lay flat configuration. The actual performance of the bag is quite surprising. When fabricated from thick plastic material, the bag can be blown full of air and seals itself. Further, once the bag has sealed itself, a 200-pound man can stand on the bag and the air inside the bag will not escape! The reader will understand that the above dimensions can be varied by simple trial and error.

In the following claims, the term "seam" will be reserved for joinder of the two parallel side edges of the tube material at the same major surface to form a joinder of the bag material. The term "seal"-will refer to any joinder of the bag material, including a seam.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A method of forming a plastic film for manufacturing a plastic bag, comprising:

providing a plastic sheet having a first edge portion and a second edge portion;

moving said plastic sheet in a first direction towards a cantilevered sealer, wherein said cantilevered sealer extends substantially along said first direction;

wrapping said plastic around said cantilevered sealer until said first edge portion and said second edge portion are near one another; and sealing said first edge portion and said second edge portion together as inner plies with said cantilevered sealer forming a tube, wherein said inner plies both extend inwardly within said tube.

2. The method of forming a plastic film of claim 1, including leaving a predefined portion unsealed, whereas the unsealed portion may be used as a valve.

3. The method of forming a tubular plastic film of claim 1, including severing a predefined length of said tube to form a film segment.

4. The method of manufacturing a bag of claim 3, including sealing at least one end of said film segment in a second direction to form a bag.

5. The method of forming a plastic film of claim 1, including winding said tube into a storage roll.

6. A method of forming a plastic film for manufacturing a plastic bag, comprising:

providing a plastic sheet having a first edge portion and a second edge portion;

moving said plastic sheet in a first direction towards a cantilevered sealer, wherein said cantilevered sealer extends substantially along said first direction;

wrapping said plastic around said cantilevered sealer until said first edge portion and said second edge portion are near one another;

sealing said first edge portion and said second edge portion together as inner plies with said cantilevered sealer forming a tube, wherein said inner plies both extend inwardly within said tube;

leaving a predefined portion unsealed, whereas the unsealed portion may be used as a valve;

severing a predefined length of said tube to form a film segment; and sealing at least one end of said film segment in a second direction to form a bag.

7. A method of forming a plastic film for manufacturing a plastic bag, comprising:

providing a plastic sheet having an outer surface, an inner surface opposite of said outer surface, a first edge portion and a second edge portion;

moving said plastic sheet in a first direction towards a cantilevered sealer, wherein said cantilevered sealer extends substantially along said first direction;

wrapping said plastic around said cantilevered sealer until said outer surface of said first edge portion is adjacent said outer surface of said second edge portion; and sealing said first edge portion and said second edge portion together as inner plies with said cantilevered sealer forming a tube, wherein said inner plies both extend inwardly within said tube.

8. The method of forming a plastic film of claim 7, including leaving a predefined portion unsealed, whereas the unsealed portion may be used as a valve.

9. The method of forming a tubular plastic film of claim 7, including severing a predefined length of said tube to form a film segment.

10. The method of manufacturing a bag of claim 9, including sealing at least one end of said film segment in a second direction to form a bag.

11. The method of forming a plastic film of claim 7, including winding said tube into a storage roll.

* * * * *